US006631529B1

(12) United States Patent
Erickson

(10) Patent No.: US 6,631,529 B1
(45) Date of Patent: Oct. 14, 2003

(54) COVER ASSEMBLY FOR MATTRESSES OF THE TYPE USED IN MEDICAL FACILITIES

(76) Inventor: Tomiko Erickson, 10100 E. Calusa Club Dr., Miami, FL (US) 33186

( * ) Notice: Subject to any disclaimer, the term of this patent is extended or adjusted under 35 U.S.C. 154(b) by 0 days.

(21) Appl. No.: 09/802,647

(22) Filed: Mar. 6, 2001

Related U.S. Application Data

(60) Provisional application No. 60/187,502, filed on Mar. 7, 2000.

(51) Int. Cl.[7] ..... A47G 9/04

(52) U.S. Cl. ..... 5/738; 5/484; 5/500; 5/739

(58) Field of Search ..... 5/737, 738, 739, 5/482, 484, 499, 500, 501, 502

(56) References Cited

U.S. PATENT DOCUMENTS

| | | | | | |
|---|---|---|---|---|---|
| 819,903 | A | * | 5/1906 | Maussner | 5/484 X |
| 1,314,408 | A | * | 8/1919 | Lewis | 112/417 |
| 1,865,018 | A | * | 6/1932 | Korney | 5/739 |
| 1,892,913 | A | * | 1/1933 | Timm | 5/738 |
| 2,879,524 | A | * | 3/1959 | Eisen | 5/484 |
| 2,963,715 | A | * | 12/1960 | Young | 5/484 X |
| 3,113,326 | A | * | 12/1963 | Hyde et al. | 5/484 |
| 3,273,177 | A | * | 9/1966 | Newton | 5/500 |
| 3,570,026 | A | * | 3/1971 | Allison | 5/486 |
| 3,581,322 | A | * | 6/1971 | Marsico | 5/738 X |
| 3,818,520 | A | * | 6/1974 | Richards, Jr. | 5/698 |
| 3,889,305 | A | * | 6/1975 | Goldberg | 5/698 |
| 4,430,765 | A | * | 2/1984 | Karpen | 5/739 X |
| 4,525,409 | A | * | 6/1985 | Elesh | 5/737 X |
| 4,704,753 | A | * | 11/1987 | Lunt | 5/502 X |
| 4,706,313 | A | * | 11/1987 | Murphy | 5/738 X |
| 4,922,565 | A | * | 5/1990 | Blake | 5/484 |
| 5,086,530 | A | * | 2/1992 | Blake | 5/484 |
| 5,090,074 | A | * | 2/1992 | Scales et al. | 5/500 X |
| 5,290,619 | A | * | 3/1994 | Siegel et al. | 5/739 X |
| 5,331,697 | A | * | 7/1994 | Siegel et al. | 5/739 |
| 5,472,766 | A | * | 12/1995 | Siegel et al. | 5/739 X |
| 6,174,584 | B1 | * | 1/2001 | Keller et al. | 5/499 X |
| 6,381,778 | B1 | * | 5/2002 | Peterson | 5/500 X |
| 2002/0148047 | A1 | * | 10/2002 | Corzani et al. | 5/738 |

FOREIGN PATENT DOCUMENTS

| | | | | |
|---|---|---|---|---|
| GB | 2012159 A | * | 7/1979 | 5/484 |

* cited by examiner

*Primary Examiner*—Robert G. Santos
(74) *Attorney, Agent, or Firm*—Malloy & Malloy, P.A.

(57) ABSTRACT

A cover assembly designed and structured to protectively enclose a mattress of the type used in medical facilities such as on hospital beds, stretchers, gurneys, etc. A casing is formed from a flexible, high strength, water impermeable material which is resistant to rupture or abrasion and which has characteristics which facilitates its use in the environment of a hospital or other medical facility. The casing includes a reinforcement assembly in the form of one or more flexible material panels, which may be formed from a material similar or identical to that from which the casing is formed and which are attached to different elongated outer walls of the casing so as to extend over a mid-portion thereof and be aligned substantially with a mid-portion of a body supported on the mattress, thereby providing supplementary support to the body so as to resist the mid-portion of the body sinking excessively into the mattress. The underlying, supported position of the one or more reinforcement panels therefore significantly reduces the tendency of the patient to develop back pain from prolonged bed rest.

20 Claims, 4 Drawing Sheets

COVER ASSEMBLY FOR MATTRESSES OF THE TYPE USED IN MEDICAL FACILITIES

CLAIM OF PRIORITY

The present application is based on and a claim to priority is made under 35 U.S.C. Section 119(e) to provisional patent application currently pending in the U.S. Patent and Trademark Office having Ser. No. 60/187,502 and a filing date of Mar. 7, 2000.

BACKGROUND OF THE INVENTION

1. Field of the Invention

The present invention relates to a cover assembly that is structured to removably enclose mattresses, and in particular, but not exclusively, the type designed for use in hospitals or like medical treatment facilities. The cover assembly includes a casing formed of a high strength, liquid impermeable material and having a variety of other structural or performance features which are preferred for use in medical facilities. The casing preferably includes a reinforcement assembly including one or more panels secured to predetermined portions of the casing so as to more reliably support portions of the user's body in a manner which will resist the heavier portion of the torso from sinking into the mattress. As such, the present invention is structured to significantly reduce, if not eliminate back pain or other discomfort commonly associated with prolonged bed rest.

2. Description of the Related Art

In virtually all hospitals, clinics or like medical facilities designed to provide health care on an "in-patient" basis, the mattress is an indispensable piece of equipment which is often overlooked, at least in terms of providing the patient with comfortable and recuperative health care. A large number of mattresses, of the type which are structurally adapted for use on adjustable hospital beds, are typically required, dependent of course upon the intended patient capacity for any given medical facility. Because of the large number of mattresses utilized in hospitals, nursing homes, clinics, etc., the cost associated with the initial purchase of mattresses in medical facilities consumes a significant portion of an institution's budget. Therefore, there may be a tendency for such institutions to accept mattresses that are manufactured to technically come within the physical and operational parameters required of medical type mattresses, but which are designed and manufactured to be simple and to be sold at a sufficiently low price so as to at least partially relieve the financial burden of initially stocking a medical facility and/or of periodically replacing mattresses over a period of time.

Accordingly, it is generally well accepted that mattresses of the type used on hospital beds, gurneys, stretchers, etc. could be constructed to provide significantly more support to a patient's body than are routinely offered by such mattresses. More in particular, mattresses intended for use in the medical field oftentimes do not provide adequate support for all or at least the major portions of a patient's body, particularly in situations where the patient is required to undergo a long period of bed rest. In fact, and as noted above, there is probably a tendency for hospitals and like medical facilities to accept mattresses which are less than optimal in terms of offering adequate, prolonged support to a patient's body in order to obtain a lower and more economical price. While such mattresses are assumed to be functional for their general intended purposes, it is believed by the inventor hereof that most, if not all hospital mattresses do not provide sufficient support of the patient's body, particularly in the general area of the trunk of the body or mid-body portion where the majority of the patient's weight is concentrated. It is understandable that one goal in the construction of mattresses is to produce a less firm or softer feel to the patient, which frequently results in the aforementioned heavier portions of the patient's body sinking or receding into the mattress. While the softer feel may initially seem to be more comfortable or even luxurious to a patient, if the patient is required or instructed to rest for long periods of time in a reclined orientation on such a mattress, it frequently results in at least some discomfort to that area of the patient's body which sinks into the mattress and/or to adjacent areas. It is believed by the inventor hereof that such patients will experience discomfort most often in the aforementioned mid-body region which normally comprises the heaviest overall portion of the patient's body. To at least some extent, some patient discomfort will likely be associated with a prolonged period of bed rest, which cannot be avoided. Even if hospital mattresses were made to be more firm, there would likely be some significant reduction in the patient's comfort, and further, the mattress would still not be likely to offer adequate support to those areas where the majority of a patient's body weight is concentrated.

From the above, it should be apparent that in the field of art relating to the construction and design of mattresses, and in particular, medical mattresses which are designed to be occupied by a patient continuously or for prolonged periods of time, there remain some fairly significant problems which have yet to be addressed. For example, while the inventor hereof believes that conventionally designed hospital mattresses add to the discomfort of patients confined to bed rest for prolonged periods, it is also believed by the inventor hereof that such mattresses are also prone to having to be replaced more often than is necessary due to their lack of offering any type of reinforcement to those areas on which a majority of the patients' weight is supported. Of course, if any type of improved hospital mattress were developed and/or an assembly for improving the features offered by conventional hospital mattresses, it/they would likely have to be structurally adapted for use with an electrically powered, mechanically adjustable hospital bed, while at the same time providing improved support and at least some generally acceptable level of comfort to a majority of patients. In addition, if any such improved hospital mattress were developed and/or an assembly for improving the features offered by conventional hospital mattresses, it/they would need to be capable of being manufactured so as to be offered at a selling price which is well within the budgetary constraints of most hospitals, other medical facilities or like institutions. It is believed by the inventor hereof that it would be preferable to develop an assembly for improving the features offered by conventional hospital mattresses, which is capable of being easily applied to such mattresses already in use by a medical facility, regardless of the intended amount of support such mattresses are originally designed to provide. Any such assembly should be capable of being removably attached or otherwise secured to a conventional hospital mattresses in a manner which provides additional reinforcing support to the heavier portions of a patient's body, so that the tendency of those portions of the body to recede or sink into the mattress is reduced, with the likely result that a primary cause of back pain or like discomfort to the patient(s) confined to bed rest is reduced, if not eliminated.

SUMMARY OF THE INVENTION

The present invention is designed to address these and other needs which remain in the art and is directed to a reinforcement assembly which, in at least one embodiment, is incorporated into the structure of a mattress cover in an operative position relative to a mattress, so as to provide supplementary support to predetermined portions of a person's body when he or she is oriented in an at least partially reclined position on the mattress. The reinforcement assembly of the present invention is therefore structured to provide an additional or supplementary supportive force to those portions of a person's body which have a tendency to recede or sink to a greater than average depth into the mattress.

A person's tendency to sink into a mattress is due at least partially to the fact that a person's body weight is normally concentrated over a specific body area. More specifically, a person of average weight and height normally has the majority of his or her body weight concentrated in an area which may be generally referred to as the trunk and/or "mid-body portion". This mid-body portion is generally defined by the area of the body extending from approximately the mid-back region to the upper thigh portion of a person's body, immediately below the buttocks. When a person reclines on a mattress in the normal fashion, the normally heavy mid-body portion, will recede or sink to a somewhat greater depth into the mattress, than the other parts of the person's body extending out from this designated mid-body portion. More specifically, the head, legs, feet, hands, etc. while varying in weight and depending upon the physique of an individual, will not have a tendency to sink into the mattress as much as the heavier mid-body portion. Such a receding body orientation, particularly over extended periods, will frequently result in a back ache or other discomfort to the various parts of a person's body located generally within the mid-body portion.

In order to overcome the aforementioned problems in the art, the reinforcement assembly of the present invention includes a casing formed of a flexible, high strength, liquid impermeable material and having a hollow interior. The hollow interior of the casing is correspondingly dimensioned and configured to a mattress, with it being intended that the mattress be removably disposed within the hollow interior of the casing. The casing includes an access opening cooperatively dimensioned and disposed so as to allow passage of the mattress therethrough as it is being inserted within or removed from the hollow interior of the casing. Further, the casing includes two primary outer walls normally disposed in spaced relation to one another when the casing is disposed in its operative position, enclosing or surrounding the mattress. In addition, a plurality of appropriately positioned side walls and/or end walls are formed on the casing and are disposed to interconnect the aforementioned two primary outer walls. The casing may be formed by an integral, substantially one piece construction although in more preferred embodiment it will be formed from a plurality of casing segments, which are interconnected to one another by a plurality of elongated seams. Preferably, the casing additionally comprises a reinforcing structure, which can be incorporated into the construction utilizing a plurality of seams, which prevents or significantly resists the seepage of bodily fluids or other liquids into the hollow interior of the casing, and which thereby prevents the mattress from being exposed to any bodily fluids, contaminants, liquid spillage, etc.

The two primary outer walls of the casing are dimensioned and configured to be disposed in overlying relation to the primary exposed surfaces of a mattress. Accordingly, a casing designed for use with a hospital bed or bed structure, other than the type used in a hospital for a gurney or stretcher, can be mounted in covering relation to the mattress, such that either of the outer walls is disposed in overlying relation to the surface or face of the mattress, on which a person is supported. The mattress can then be turned over, such that the opposite side previously defining the under surface of the mattress, can be disposed in an outwardly extending position and be the primary supporting surface on which a person is oriented.

In at least one embodiment, the casing of the present invention is also intended for use on a mattress that is used with a stretcher. Typically, as stretchers are used to move a patient about within a hospital or otherwise, the cover for a stretcher type of mattress includes an attachment structure, such as in the form of an elongated strip of Velcro™ or other hook and loop type fastener formed on an outer, undersurface thereof. The elongated attachment strip is matable and removably securable to a similarly structured strip disposed on the supporting platform or surface of which the stretcher rests. Interconnection of the two attachment strips eliminates or significantly reduces the possibility of the mattress becoming inadvertently dislodged from the stretcher, even when the stretcher is disposed at relatively severe or unusual orientations, such as during the transport of a patient. Accordingly, in one embodiment of the present invention, the casing is designed for use with a stretcher mattress, and which, while incorporating two spaced apart and primary outer walls, only one of such outer walls will be oriented in overlying, covering relation to the surface or face of the mattress that is designed to underlie and support a patient, whereas the opposite outer wall will include an elongated attachment strip mounted thereon for removable securement to the supporting platform for the stretcher mattress.

The casing of the present invention preferably also comprises a reinforcement assembly in all of the various embodiments. The reinforcement assembly includes at least one reinforcing panel secured to at least one of the outer walls of the casing and extending transversely across the corresponding outer walls substantially between and in contiguous relation with the longitudinal, peripheral edges of the outer wall. Further, the dimension and configuration of the reinforcing panel is such as to overly a mid-portion thereof, preferably in spaced relation to the opposite ends of the outer wall and the casing itself, thereby providing a reinforcing, supplementary support, at least to that portion of the casing and mattress on which the patient's middle body or trunk will be supported. The panel is formed from a flexible, and yet, high strength, durable, tear and abrasion resistant material that is structured to resist the sinking or recessing of a patient's middle body portion into the mattress. The parts of the casing body which extend outside the aforementioned middle body portion will preferably not include the supplementary, reinforcing support applied thereto, since the head, shoulders, legs, feet, of a patient are not individually of sufficient weight to cause sinking into the mattress. A back ache or other discomfort normally associated with the unsupported orientation of the patient, such as when the reinforcing panel is not utilized, is thereby prevented or significantly reduced.

In at least one embodiment of the present invention, the casing includes two reinforcing panels each mounted on the interior of the casing in confronting engagement with different ones of the outer walls and in generally spaced relation to the opposite ends of the respective outer walls, such that each panel is disposed to provide supplementary support to the middle body portion as versus the parts of the body outside of the mid-body portion region. Since the casing of this embodiment is intended for use on a hospital bed mattress as versus a stretcher mattress, the mattress may be turned repeatedly without requiring the removal of the casing from the mattress. When the casing of the present invention is intended for use on a stretcher mattress, preferably only a single reinforcing panel is mounted within the hollow interior in direct confronting relation to a mid-portion of the primary outer wall, which does not include the aforementioned elongated attachment strip used to removably secure the casing and the mattress contained therein to the stretcher.

It should also be noted that the casing as well as the reinforcing panels are preferably formed from the high strength, durable, liquid impermeable material of the type set forth above. In addition, the material may also have certain other characteristics such as being electrically conductive, flame retardant, antibacterial, nonallergenic, etc. By way of example, materials from which the casing, as well as the one or more reinforcing panels may be formed and manufactured are commercially available under the trademarks STAPH CHECK™ or ELECTROLITE™, both of which are produced by Herculite Products, Inc. of York, Pa. It is pointed out that other materials having more or less of these desirable characteristics may also be utilized.

The objects, features and advantages of the present invention will become more clear when the drawings, as well as the detailed description which follows, are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

With reference to the accompanying Figures, the present invention is directed to a cover assembly, generally indicated as 10, for a mattress. The cover assembly 10 primarily comprises a casing 12 that is correspondingly dimensioned and configured to completely enclose a mattress, not particularly shown, and preferably, a reinforcement assembly incorporated therein. While the cover assembly 10 is primarily designed to be used in combination with mattresses of the type used in medical facilities, such as a hospital bed mattress and/or a mattress used on a gurney or stretcher, the important features of the present invention could also be incorporated, if desired, within a casing that is adapted for use with a more conventional mattress of the type used domestically, in households or commercially, in hotels or other temporary residential facilities.

Figure 1:
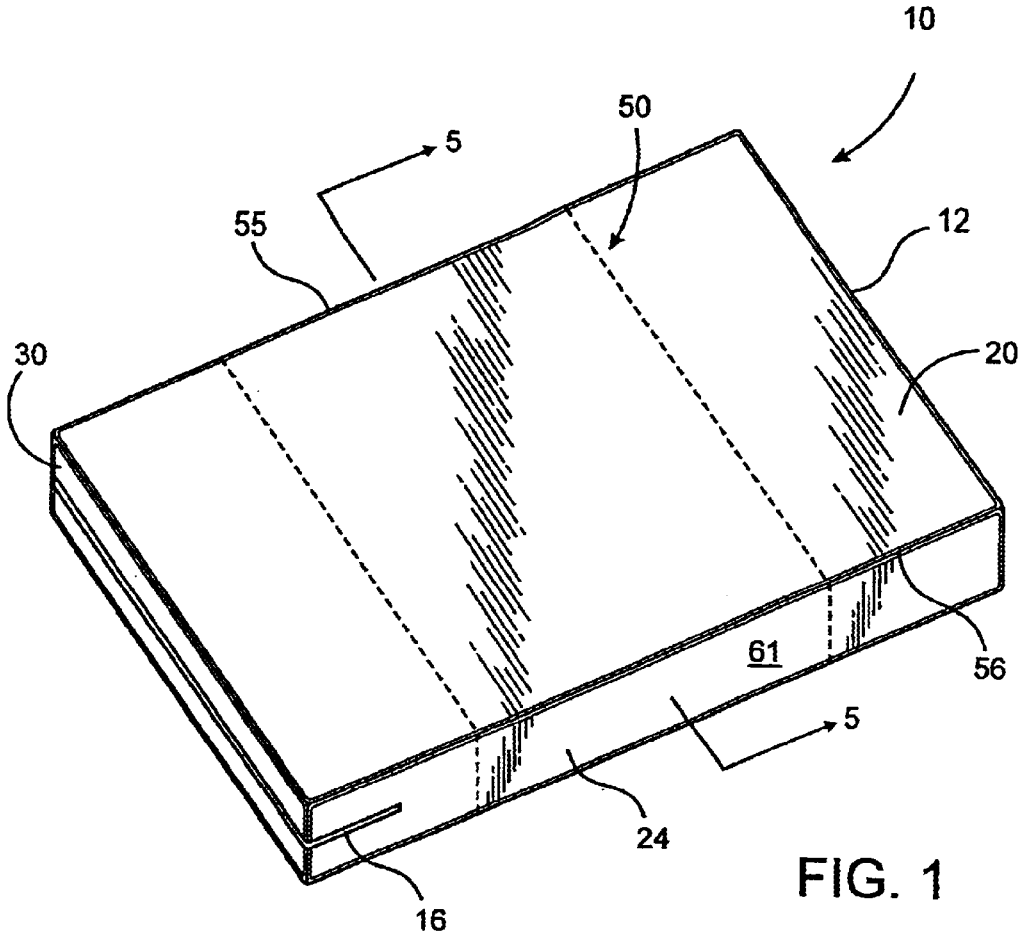
FIG. 1 is a perspective view showing one embodiment of a casing in accordance with the cover assembly of the present invention and including a reinforcement assembly as indicated by the phantom lines.
Figure 2:
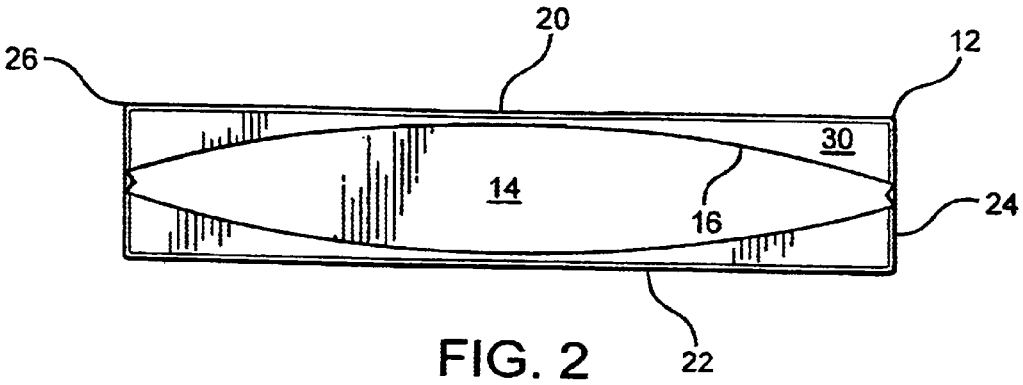
FIG. 2 is an end view of the embodiment of FIG. 1 showing an access opening into the hollow interior thereof.

With reference to FIGS. 1 and 2, the casing 12 includes a hollow interior 14 and an access opening 16 that is cooperatively dimensioned and disposed relative to the hollow interior 14 so as to allow passage therethrough of a mattress into and out of the casing 12. A closure structure of somewhat conventional design such as, but not necessarily limited to, a zipper, hook and loop type fastener, etc. may be mounted on the periphery of the access opening 16 so as to removably secure the casing 12 about the mattress, with the access opening 16 in a closed position. As is perhaps best shown in FIG. 2, the casing 12 includes two spaced apart, outer walls 20 and 22 separated by the hollow interior 14 when the casing 12 is disposed in its operative position in surrounding protective relation to a mattress. In addition, the casing may include side walls 24 and 26, and oppositely disposed end walls 28 and 30 as shown in FIG. 1, wherein the access opening 16 is formed in one of the end walls 30. It is pointed out that the access opening 16 could also be formed at any one of a plurality of other locations on the casing 12.

Figure 7:
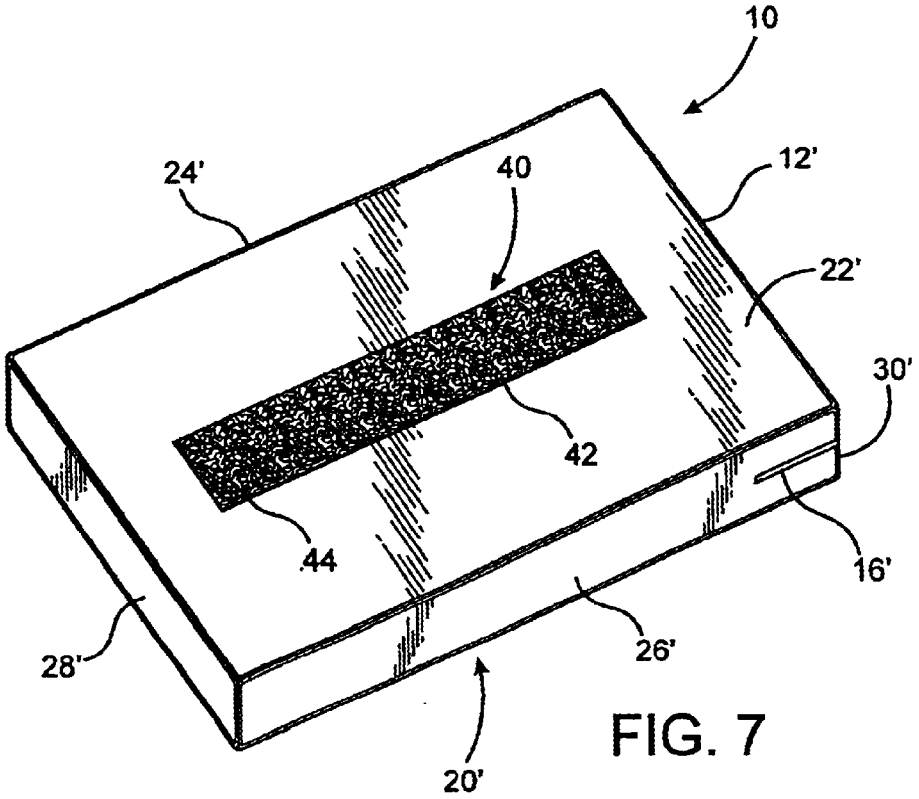
FIG. 7 is a perspective view of another embodiment of the cover assembly incorporating the reinforcement assembly of the present invention.

As shown in FIG. 7, another embodiment of the casing is generally represented as 12', and may include similar structural components, including two outer walls 22' and 20' disposed in spaced relation to one another and separated by the hollow interior 14. The casing 12' of this embodiment may also include the various side walls and end walls 24', 26', 28', and 30' as well as the access opening 16', as described above. A distinguishing feature of the casing 12' from the embodiment of FIGS. 1 through 4, however, is its use as a cover assembly for a mattress intended to be used on a gurney, stretcher or like mobil support assembly designed to transport patients between locations. Accordingly, one of the outer walls, such as 22' of the casing 12' will preferably include an attachment assembly, generally indicated as 40. The attachment assembly 40 may include an elongated strip, as at 42, having a connector structure, such as Velcro™ or another hook and loop type fastener 44, extending over at least the majority of the exposed surface of the strip 42. This attachment assembly 40 is designed to mate with a similar connector structure and/or elongated strip of mating hook and loop type fastener that is mounted on the bed or support platform for the stretcher, gurney, etc. Thus, the outer wall of the casing which includes the attachment assembly 40 will in all likelihood be always disposed in direct confronting relation to the support portion of the stretcher, gurney, or the like in order to prevent the inadvertent displacement of the stretcher type mattress, disposed within the hollow interior 14 of the casing 12', from its intended position on the stretcher or gurney as it is used to transport a patient from one location to another.

Figure 3:
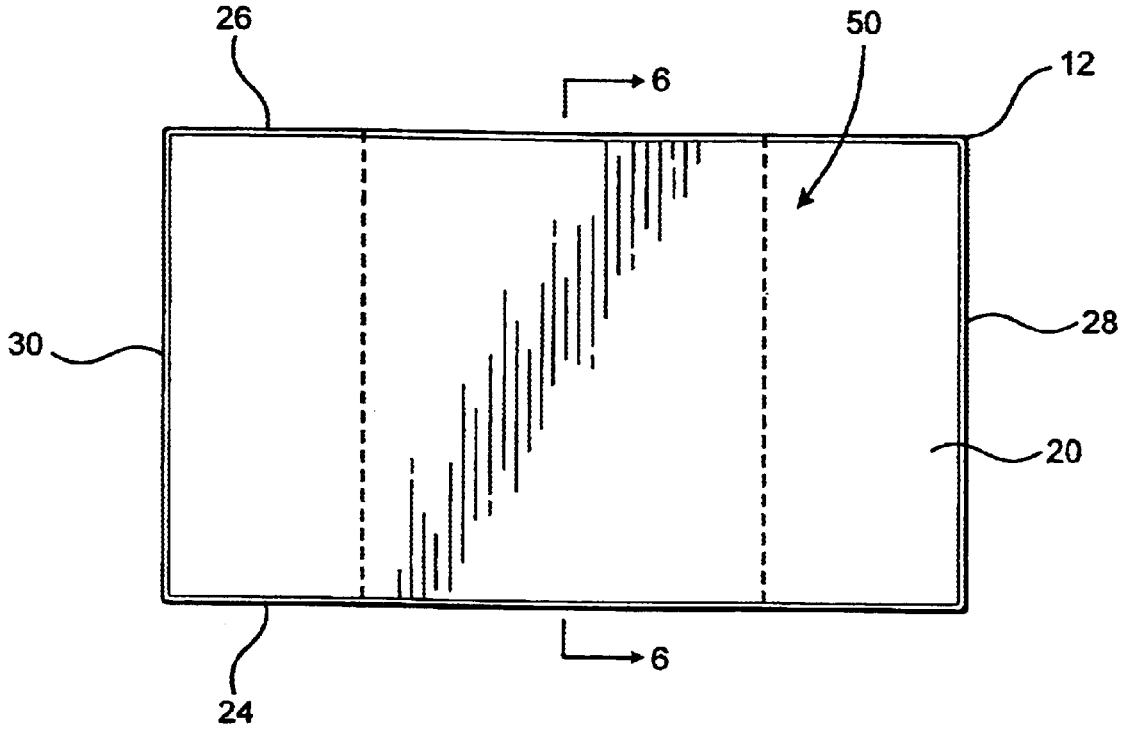
FIG. 3 is a top view of the embodiment of FIG. 1.
Figure 4:
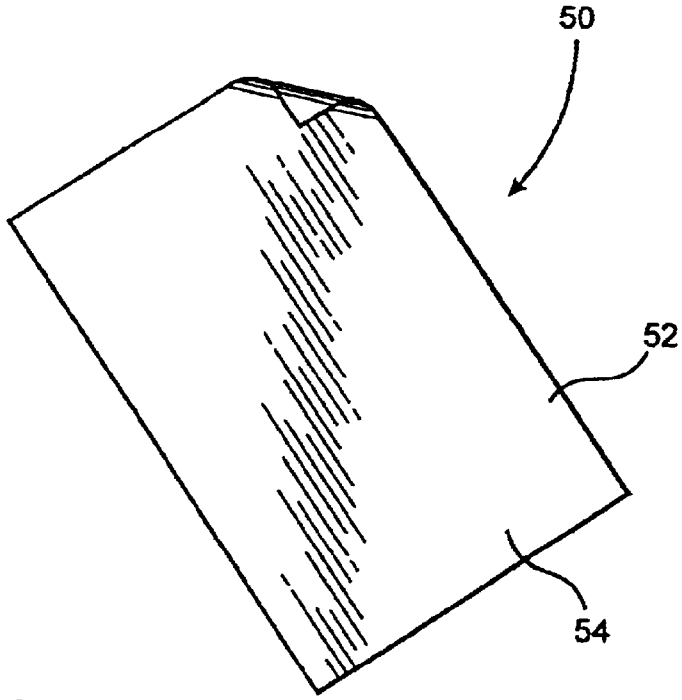
FIG. 4 is a perspective view of a reinforcing panel associated with the reinforcement assembly of the present invention.
Figure 5:
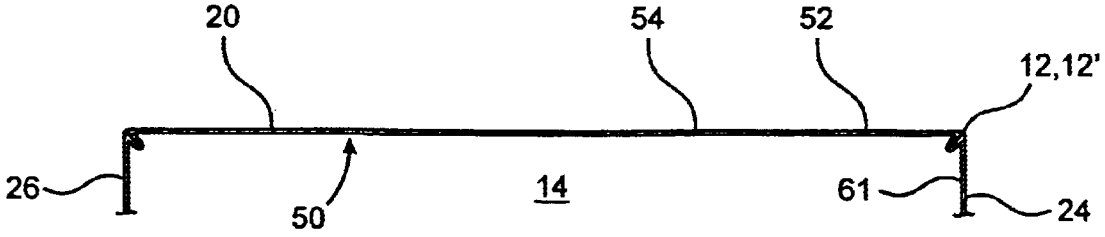
FIG. 5 is a sectional view in partial cutaway along lines 5—5 of FIG. 1.
Figure 6:
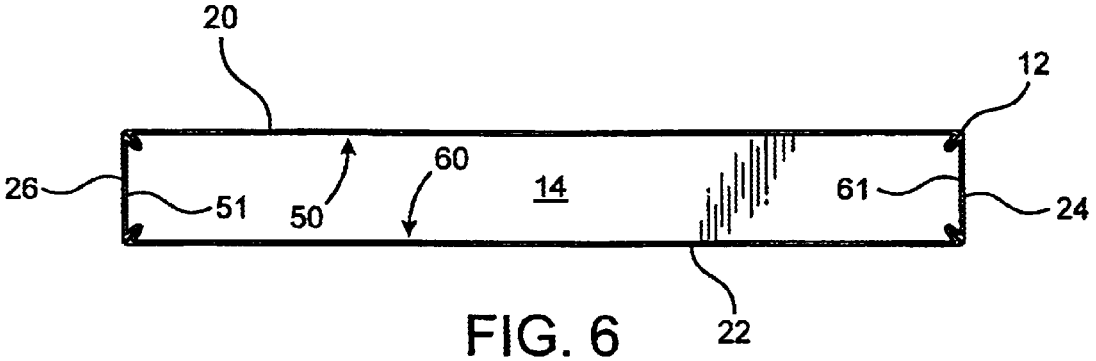
FIG. 6 is a sectional view along line 6—6 of FIG. 3.

The present invention preferably also comprises a reinforcement assembly incorporated within either of the embodiments of the casing 12 or 12' and will include at least one reinforcing panel, generally indicated as 50, as shown in FIGS. 1 and 3. The reinforcing panel 50 is preferably formed from a flexible, and yet high strength material that is also durable and tear resistant. The material from which the reinforcing panel is formed may be the same as or equivalent to that material from which the casing 12 or 12' is formed. As set forth above, the material of both the casing 12, 12' and the one or more reinforcing panels 50 may also have other operational characteristics which are preferred or required when such material is used in a hospital, other medical facility or like health care environment, such as being liquid impermeable, bacteria resistant, etc. With reference to FIGS. 5 and 6, the at least one reinforcing panel 50 is preferably, but does not necessarily have to be mounted within the hollow interior 14 of the casing 12 or 12'. In this illustrated embodiment, the reinforcing panel includes an interior surface 52 disposed in direct confronting engagement with a corresponding interior surface portion of at least one of the outer walls 20, as shown in detail in FIG. 5. In at least one embodiment, the reinforcing panel 50 is secured by an adhesive 54 extending over at least the majority, if not all of the interior surface 52. The adhesive 54 is disposed in confronting engagement with the corresponding interior surface portion of the outer wall 20, such that the panel confronts the interior surface of the wall 20 substantially over its entire surface area.

As illustrated in FIG. 1, the dimension and configuration of the at least one reinforcing panel 50 may be such that it extends substantially across the entire width of the outer wall 20 between the longitudinal peripheral edges 55 and 56 thereof. In addition, at least one embodiment of the reinforcement assembly of the present invention comprises the reinforcing panel 50 disposed in spaced relation to the opposite ends of both the upper wall 20 and the casing 12 and/or 12', as will be described in greater detail hereinafter. Further, in a most preferred embodiment of the present invention, the disposition and dimension of the panel 50 relative to the casing 12 or 12' is such that it is substantially equally spaced from the opposite ends 28, 30 of the casing 12 or 12'. By way of example, the conventional mattress of the type used on a hospital bed or the like, has a length of substantially 80 inches and a width of substantially 36 inches. In one embodiment of the present invention, the at least one reinforcing panel 50 extends generally along a 40 to 42 inch region of the middle portion of the casing 12 which, as set forth above, is correspondingly dimensioned and associated with that portion of the mattress on which a patient's heaviest body weight will be supported. Therefore, the reinforcing panel 50 is ideally spaced from each of the opposite ends 28, 30 of the casing 12, 12' a distance of generally about 18 to 20 inches. As such, the reinforcing panel 50 is dimensioned and configured to be disposed in aligned, underlying and substantially supporting relation to the aforementioned mid-body portion, which generally extends from the upper and/or middle back of a person's body to the upper thigh and/or area of the body immediately below the buttocks. By virtue of the disposition, dimension and configuration of the reinforcing panel 50, that portion of a person's body along which the majority of his or her weight is concentrated is provided with supplementary support to resist the tendency of a patient to sink into or cause an indentation in the mattress. The patient is thereby prevented from being disposed in a receded and somewhat unnatural orientation which, as set forth above, frequently causes pain and discomfort particularly in situations where the patient is involved in extended bed rest.

As indicated, the reinforcing assembly of the present invention may involve the use of only a single reinforcing panel 50, particularly when the panel 50 is applied to a casing 12' designed to be used to cover a stretcher-type mattress. However, and with reference to FIG. 6, the reinforcing assembly of the present invention may also include at least two panels 50 and 60 disposed in spaced relation to one another and mounted on the interior 14 of the casing 12, so as to engage the interior surface of each of the outer walls 20 and 22. Attachment of each of the panels 50 and 60 is preferably also accomplished by means of an adhesive 54 in the same manner described above with reference to the embodiment incorporating the use of a single reinforcing panel 50. Also, in order to facilitate production or provide even greater support and stability, the at least one reinforcing panel 50 and/or the two panels 50 and 60 may additionally be interconnected by reinforcing side panel segments 51 and 61 secured to the inner surface of the casing's outer walls 26 and 24 respectively, as shown in FIG. 6.

Figure 8:
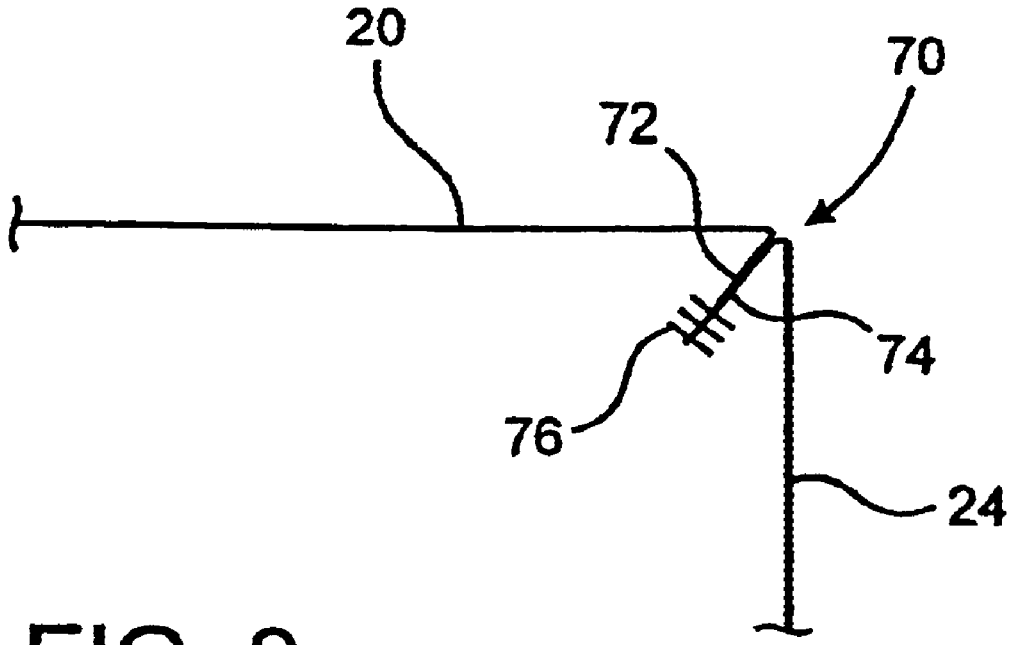
FIG. 8 is a detailed sectional view in partial cutaway of a seam structure, in a partially assembled form, designed to interconnect segments of the casing and comprising a portion of the reinforcement assembly of the present invention.
Figure 9:
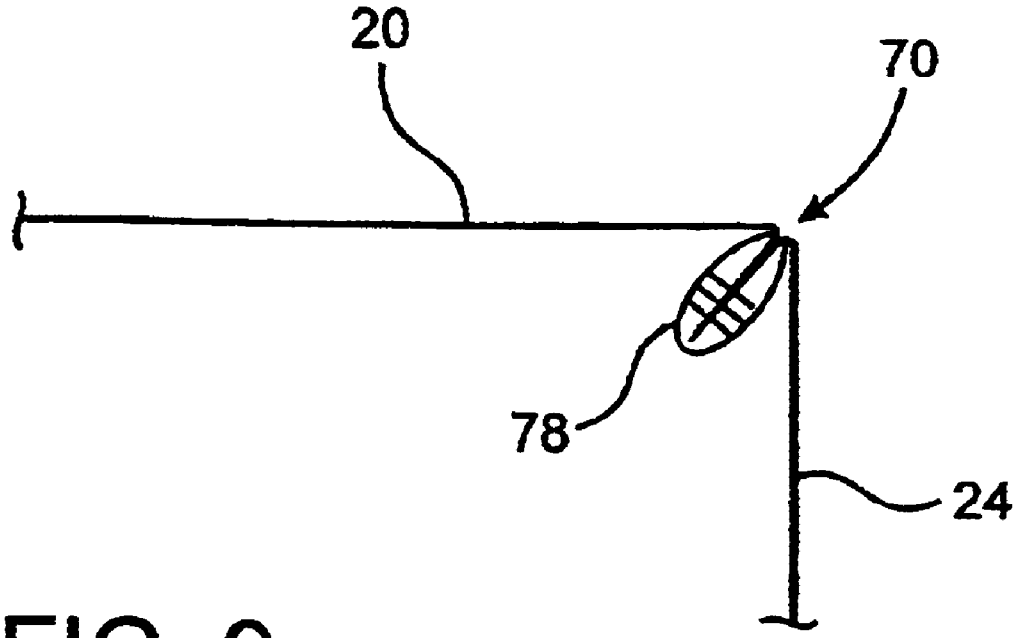
FIG. 9 is a detailed sectional view in partial cutaway similar to that of FIG. 8 but also including a protective band which also defines a portion of the reinforcement assembly of the present invention.

The cover assembly 10 of the present invention will preferably also include a reinforcing seam structure, as generally indicated by 70 in FIGS. 8 and 9, which serves to additionally protect and isolate the mattress from possible contamination by a patient's blood or other bodily fluids. The reinforcing seam structure 70 may include correspondingly disposed peripheral edges 72 and 74 of the adjoining outer walls 20 and 24 of the casing 12 being secured together as by an initial set of stitching 76, although the peripheral edges of the reinforcement panel 50 may also be sewn together with edges 72 and 74. Thereafter, the sewn together peripheral edges 72 and 74 are preferably folded over onto itself and another set of stitching is applied, as at 78 in FIG. 9, so as to form a pocket or air filled chamber between stitching 76 and 78 that serves as a barrier to any blood or bodily fluid that might leak or be spilled onto the casing 12. Alternatively, an elongated strip or band of the material used to form the reinforcing panel 50, indicated as 78 in FIG. 9, may be disposed in overlying, covering relation to the peripheral edges 72 and 74 of the casing outer walls, once secured together by initial stitching 76. In any event, it is preferred that this reinforced seam structure 70 may extend along the length of each of the seams used to connect the various segments of the casing 12 or 12' to one another in order to prevent seepage of liquid into the interior 14 of the casing 12 or 12'.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A cover assembly for a mattress comprising:

a) a casing formed from a flexible material and including a hollow interior dimensioned to removably receive the mattress therein, b) said casing including two outer walls disposed in spaced relation to one another by said hollow interior, c) each of said outer walls extending along the length of said casing and terminating at opposite ends thereof, d) a reinforcement assembly secured to said casing and disposed in substantially aligned and supporting relation to a predetermined portion of a body of a person supported on the mattress, e) said reinforcement assembly comprises at least one panel secured to at least one of said outer walls within said hollow interior and extending transversely between opposite longitudinal sides thereof, and f) said at least one panel extends along generally 50% of said outer walls and is disposed in equal substantially spaced relation from said opposite ends of said casing.

2. A cover assembly as recited in claim 1 wherein the predetermined body portion comprises a portion of the torso extending at least from substantially the middle back to the upper thigh.

3. A cover assembly as recited in claim 1 wherein said at least one panel is formed of a flexible material.

4. A cover assembly as recited in claim 1 wherein said at least one panel includes an inner surface attached in direct confronting relation to said outer wall.

5. A cover assembly as recited in claim 1 wherein said reinforcement assembly comprises at least two panels each secured to a different one of said outer walls.

6. A cover assembly as recited in claim 5 wherein said panels are formed of a flexible, high strength, liquid impermeable material.

7. A cover as recited in claim 5 wherein in one of said outer walls is disposed in underlying, substantially supporting relation to a mid-portion of the body supported on the mattress.

8. A cover assembly as recited in claim 5 wherein each of said panels is disposed within said hollow interior in confronting engagement with corresponding ones of said outer walls.

9. A cover assembly as recited in claim 8 wherein each of said panels extends along generally 50% of a corresponding one of said outer walls in equal substantially spaced relation to said opposite ends of said casing.

10. A cover assembly as recited in claim 1 wherein said reinforcement assembly further comprises a reinforced seam structure including peripheral edges of segments of said casing secured together along their respective lengths prior to disposing a protective band in overlying substantially covering relation to said secured peripheral edges.

11. A cover assembly as recited in claim 10 wherein said peripheral edges and said protective band are interconnected by stitching.

12. A cover assembly for a mattress comprising:

a) a casing including a hollow interior and two elongated outer walls defining the length of said casing and disposed in spaced relation to one another by said hollow interior, b) an access opening disposed in communicating relation with said hollow interior and cooperatively dimensioned therewith to allow passage of the mattress into and out of said hollow interior, c) a reinforcement assembly secured to said casing and disposed in substantially aligned and supporting relation to a predetermined portion of a body of a person supported on the mattress, d) said reinforcement assembly comprises at least one panel secured to at least one of said outer walls within said hollow interior and extending transversely between opposite longitudinal sides thereof, e) said at least one panel extends along generally 50% of said outer walls and is disposed in equal substantially spaced relation from said opposite ends of said casing, and f) said casing and at least a portion of said reinforcement assembly formed from a flexible, high strength, liquid impermeable material.

13. A cover as recited in claim 12 wherein the predetermined body portion comprises a portion of the torso extending at least from substantially the middle back to if immediately below the buttocks.

14. A cover assembly as recited in claim 12 wherein said reinforcement assembly further comprises a reinforced seam structure including peripheral edges of corresponding segments of said casing secured together along their respective lengths prior to disposing a protective band in overlying relation to said secured peripheral edges.

15. A cover assembly as recited in claim 12 wherein said reinforcement assembly comprises at least two panels each secured to a different one of said outer walls.

16. A cover assembly as recited in claim 15 wherein either of said panels is disposed in underlying, substantially supporting relation to a mid-portion of the body supported on the mattress.

17. A cover assembly as recited in claim 16 wherein each of said panels is disposed within said hollow interior portion in confronting engagement with corresponding ones of said outer walls.

18. A cover assembly as recited in claim 16 wherein said reinforcement assembly further comprises a reinforced seam structure including peripheral edges of segments of said casing secured together along their respective lengths prior to disposing a protective band in overlying substantially covering relation to said secured peripheral edges.

19. A cover assembly as recited in claim 15 wherein said panels are interconnected and collectively extend substantially continuously around an interior surface of said casing in transverse relation to the length thereof.

20. A cover assembly as recited in claim 19 wherein said panels are formed from a flexible, high strength, liquid impermeable material.

* * * * *